US012091786B2

(12) United States Patent
Dombrow et al.

(10) Patent No.: US 12,091,786 B2
(45) Date of Patent: Sep. 17, 2024

(54) FOOTWEAR INCLUDING A TEXTILE UPPER

(71) Applicant: Under Armour, Inc., Baltimore, MD (US)

(72) Inventors: David Dombrow, Baltimore, MD (US); Kevin P. Fallon, Portland, OR (US); Thomas White, Baltimore, MD (US)

(73) Assignee: Under Armour, Inc., Baltimore, MD (US)

( * ) Notice: Subject to any disclaimer, the term of this patent is extended or adjusted under 35 U.S.C. 154(b) by 353 days.

(21) Appl. No.: 16/984,346

(22) Filed: Aug. 4, 2020

(65) Prior Publication Data

US 2021/0052038 A1 Feb. 25, 2021

Related U.S. Application Data

(63) Continuation of application No. 15/149,596, filed on May 9, 2016, now abandoned.
(Continued)

(51) Int. Cl.
*D04B 1/24* (2006.01)
*A43B 1/04* (2022.01)
(Continued)

(52) U.S. Cl.
CPC ..... *D04B 1/24* (2013.01); *A43B 1/04* (2013.01); *A43B 23/0235* (2013.01); *D04B 1/123* (2013.01); *D04B 1/14* (2013.01); *D04B 1/16* (2013.01); *D04B 1/22* (2013.01); *A43B 5/06* (2013.01); *A43B 7/085* (2013.01); *A43B 23/0205* (2013.01); *A43B 23/0275* (2013.01);
(Continued)

(58) Field of Classification Search
CPC ..... A43B 1/04
See application file for complete search history.

(56) References Cited

U.S. PATENT DOCUMENTS

RE18,804 E 4/1933 Joha
D90,369 S 7/1933 Ludwick
(Continued)

FOREIGN PATENT DOCUMENTS

EP 0632972 B1 9/1996
EP 1130146 A4 9/2004
(Continued)

OTHER PUBLICATIONS

U.S. Appl. No. 17/347,011, filed Mar. 25, 2008, Dua, et al.
(Continued)

*Primary Examiner* — Megan E Lynch
(74) *Attorney, Agent, or Firm* — Edell, Shapiro & Finnan, LLC

(57) ABSTRACT

A textile upper for an article of footwear includes at least one microclimate modulation structure located at one or more regions of the upper. In an embodiment, a microclimate modulation structure includes a plurality of knitted strands, the knitted strands including a first strand type and a second strand type, the first strand type having a greater thermal conductivity than the second strand type. In another embodiment, the microclimate modulation structure includes an uneven surface that includes a plurality of knitted beams and a plurality of indentations defined between the knitted beams.

7 Claims, 12 Drawing Sheets

Related U.S. Application Data

(60) Provisional application No. 62/158,709, filed on May 8, 2015.

(51) Int. Cl.

| | |
|---|---|
| ***A43B 23/02*** | (2006.01) |
| ***D04B 1/12*** | (2006.01) |
| ***D04B 1/14*** | (2006.01) |
| ***D04B 1/16*** | (2006.01) |
| ***D04B 1/22*** | (2006.01) |
| *A43B 5/06* | (2022.01) |
| *A43B 7/08* | (2022.01) |
| *A43C 1/00* | (2006.01) |
| *A43C 1/04* | (2006.01) |

(52) U.S. Cl.

CPC ..... *A43B 23/028* (2013.01); *A43C 1/00* (2013.01); *A43C 1/04* (2013.01); *D10B 2501/043* (2013.01)

(56) References Cited

U.S. PATENT DOCUMENTS 2,147,197 A 2/1939 Glidden
2,230,915 A 2/1941 Spiro
2,314,098 A 3/1943 McDonald
2,334,659 A 11/1943 Van Arsdale et al.
2,335,210 A 11/1943 Guinzberg
2,345,055 A 3/1944 Lilley et al.
2,400,692 A 5/1946 Herbert
2,440,393 A 4/1948 Clark
2,467,237 A 4/1949 Sherman et al.
2,495,984 A 1/1950 Roy
2,538,673 A 1/1951 Donahue
2,586,045 A 2/1952 Hoza
2,636,287 A 4/1953 Heilbronner
2,641,004 A 6/1953 Whiting et al.
2,675,631 A 4/1954 Doughty
2,679,117 A 5/1954 Reed
3,093,916 A 6/1963 Hiestand et al.
3,631,666 A 1/1972 Kim
3,655,420 A 4/1972 Tichenor
3,667,207 A 6/1972 Ben
3,925,912 A 12/1975 Martuneau
4,119,589 A 9/1978 Spolnicki
4,232,458 A * 11/1980 Bartels ..... A43B 7/06 139/413
D292,941 S 12/1987 Kelley
4,785,558 A 11/1988 Shiomura
D309,822 S 8/1990 Barret
5,086,576 A 2/1992 Lamson
5,282,846 A 2/1994 Schmitt
5,345,638 A 9/1994 Nishida
5,365,677 A 11/1994 Dalhgren
D375,617 S 11/1996 Orzeck
D377,414 S 1/1997 Hatfield
5,700,573 A 12/1997 McCullough
5,784,806 A 7/1998 Wendt
5,811,186 A 9/1998 Martin
5,965,223 A 10/1999 Andrews et al.
D428,239 S 7/2000 Plamondon
D438,697 S 3/2001 Matis
D444,624 S 7/2001 Wilson
D447,858 S 9/2001 Matis
D458,015 S 6/2002 Dolan
6,677,038 B1 1/2004 Topolkaraev
D494,353 S 8/2004 McDowell
6,880,268 B2 4/2005 Chen
6,910,288 B2 6/2005 Dua
6,931,762 B1 * 8/2005 Dua ..... A43B 23/042 66/185
6,986,269 B2 1/2006 Dua
D520,225 S 5/2006 Choi
D521,226 S 5/2006 Douglas
7,051,460 B2 5/2006 Orei et al.
D526,771 S 8/2006 Fallon
7,131,296 B2 11/2006 Dua et al.
D545,557 S 7/2007 Caine
D549,441 S 8/2007 Chang
D551,841 S 10/2007 Choi
7,338,877 B1 3/2008 Meyer
D572,453 S 7/2008 Alfaro
D574,591 S 8/2008 Belley
D578,294 S 10/2008 Mervar
D624,297 S 9/2010 Henderson
D625,331 S 10/2010 Umezawa
D636,569 S 4/2011 McMillan
D636,584 S 4/2011 Williams, Jr.
D639,543 S 6/2011 Lamont
8,028,440 B2 10/2011 Sokolowski et al.
8,042,288 B2 10/2011 Dua et al.
D661,884 S 6/2012 Raysse
8,209,883 B2 7/2012 Lyden
8,241,651 B2 8/2012 Lahann
8,266,749 B2 9/2012 Dua et al.
D668,858 S 10/2012 Shaffer
8,448,474 B1 5/2013 Tatler et al.
8,590,345 B2 11/2013 Sokolowski et al.
8,595,878 B2 12/2013 Huffa et al.
8,621,891 B2 1/2014 Dua et al.
8,650,916 B2 2/2014 Dua et al.
8,701,232 B1 4/2014 Droege et al.
D707,436 S 6/2014 Seamarks
D707,943 S 7/2014 Nascimento
D707,947 S 7/2014 Seamarks
D709,280 S 7/2014 Shaffer
8,800,172 B2 8/2014 Dua et al.
8,839,532 B2 9/2014 Huffa et al.
8,881,430 B2 11/2014 Seamarks et al.
D722,226 S 2/2015 Williams, Jr.
8,950,088 B2 2/2015 Aveni et al.
8,959,959 B1 2/2015 Podhajny
8,973,288 B2 3/2015 Dojan et al.
8,973,410 B1 3/2015 Podhajny
8,997,529 B1 4/2015 Podhajny
9,032,763 B2 5/2015 Meir et al.
D731,765 S 6/2015 Opie
9,060,562 B2 6/2015 Meir et al.
9,078,488 B1 * 7/2015 Meir ..... D04B 1/22
D735,465 S 8/2015 Petrie
D737,552 S 9/2015 Guichot
D738,085 S 9/2015 Kirschner
D738,089 S 9/2015 Avar
9,149,086 B2 10/2015 Greene et al.
9,150,986 B2 10/2015 Dua et al.
9,192,204 B1 11/2015 Liles et al.
D748,389 S 2/2016 Small
D753,376 S 4/2016 Birkinhead
9,404,205 B2 8/2016 Meir
D765,964 S 9/2016 Fallon
D772,553 S 11/2016 Williams, Jr.
9,491,987 B2 11/2016 Antonelli et al.
9,510,637 B2 12/2016 Podhajny et al.
9,578,928 B2 2/2017 Farris
2004/0110442 A1 6/2004 Rhim
2004/0118018 A1 6/2004 Dua et al.
2005/0193592 A1 9/2005 Dua et al.
2009/0126231 A1 5/2009 Malmivaara
2010/0051132 A1 3/2010 Glenn
2011/0003524 A1 1/2011 Claasen
2011/0041232 A1 2/2011 Covelli
2011/0283435 A1 11/2011 Smith
2012/0055044 A1 3/2012 Dojan et al.
2012/0233882 A1 * 9/2012 Huffa ..... A43B 23/045 36/45
2012/0255201 A1 10/2012 Little
2014/0130373 A1 * 5/2014 Baines ..... A43B 7/12 36/84
2014/0137434 A1 5/2014 Craig
2014/0196311 A1 7/2014 Follet et al.
2014/0237861 A1 * 8/2014 Podhajny ..... D04B 15/56 66/170

(56) References Cited

U.S. PATENT DOCUMENTS

| | | | | |
|---|---|---|---|---|
| 2014/0259760 | A1* | 9/2014 | Dojan | A43B 23/0225 12/146 C |
| 2014/0310983 | A1 | 10/2014 | Tamm | |
| 2015/0013080 | A1 | 1/2015 | Thomas et al. | |
| 2015/0047227 | A1 | 2/2015 | Fallon et al. | |
| 2015/0059211 | A1 | 3/2015 | Droege et al. | |
| 2015/0107307 | A1 | 4/2015 | Kosui et al. | |
| 2015/0320136 | A1 | 11/2015 | Dua et al. | |
| 2015/0342285 | A1 | 12/2015 | Huffman | |
| 2016/0058099 | A1 | 3/2016 | Panian | |
| 2016/0058100 | A1* | 3/2016 | Dealey | D04B 1/16 12/142 G |
| 2017/0215523 | A1* | 8/2017 | Nishiwaki | A43B 23/0265 |

FOREIGN PATENT DOCUMENTS

| | | | |
|---|---|---|---|
| EP | 2792260 | A3 | 12/2014 |
| EP | 2792264 | A3 | 12/2014 |
| EP | 2792265 | A3 | 12/2014 |
| EP | 2149629 | B1 | 1/2015 |
| GB | 0012787 | B2 | 6/1904 |

OTHER PUBLICATIONS

U.S. Appl. No. 17/637,032, filed Dec. 29, 2009, Sokolowski, et al.
U.S. Appl. No. 17/774,956, filed Aug. 17, 2010, Dua, et al.
U.S. Appl. No. 17/814,598, filed Oct. 19, 2010, Dua, et al.
Thermal Conductivity of some common Materials and Gases' (The Engineering Toolbox) Jan. 7, 2015 (Jan. 7, 2015) [online] retrieved from URL:https://web.archive.org/web/20150107151233/http://www.engineeringtoolbox.com/thermal-conductivity-d_429.html> pp. 2-3.
Written Opinion and International Search Report from Related PCT Application No. PCT/US16/031093 {mailed Aug. 31, 2016}.
Supplementary European Search Report, EP16793231, date of completion Dec. 11, 2018, 8 pages.
Goodfellow, Polyethylene—U.H.M.W. (UHMW PE) Material Information, https://web.archive.org/web/20100423161458/http://www.goodfellow.com/E/Polyethylene-UMW.html, Apr. 23, 2010.
Textile Innovation Knowledge Platform, Dec. 29, 2013, htlp://www.tikp.eo.uk/knowledge/technology/knitting/priciples/.

* cited by examiner

FOOTWEAR INCLUDING A TEXTILE UPPER

CROSS REFERENCE TO RELATED APPLICATIONS

The present application is a continuation of U.S. patent application Ser. No. 15/149,596, filed May 9, 2016 and entitled "Footwear Including a Textile Upper", which claims priority to U.S. Provisional Patent Application Ser. No. 62/158,709, filed May 8, 2015 and entitled "Footwear Including a Textile Upper." The disclosure of the aforementioned applications are incorporated herein by reference in their entireties.

FIELD OF THE INVENTION

The present invention relates to an article of footwear and, in particular, footwear including an upper with a temperature modulation structure.

BACKGROUND

Articles of footwear typically include an upper and a sole structure attached to the upper that cooperate to define a foot cavity. Controlling the microclimate of the foot cavity—the temperature and humidity within the foot cavity, including the position of air layers relative to the foot or sock—is important for wearer comfort. High temperature and humidity inside the foot cavity may cause discomfort and/or affect blood flow (straining on the wearer's vascular system). Excessive humidity within the foot cavity, moreover, may promote the growth of microorganisms (fungi and bacteria).

Accordingly, it would be desirable to provide an upper for footwear capable of affecting the microclimate within the foot cavity.

SUMMARY OF THE INVENTION

An article of footwear includes a sole structure and an upper attached to the sole structure. The upper is formed from a textile including interlocked strands oriented in a predetermined configuration. The upper further includes a microclimate modulation structure operable to affect the microclimate of the foot cavity. The microclimate modulation structure includes pockets configured to capture heated and/or moist air away from the surface of the foot. The microclimate modulation structure further includes strands possessing high thermal conductivity that selectively positioned within the textile structure. The high thermal conductivity strands are capable of transferring heat at a higher rate than surrounding strands.

BRIEF DESCRIPTION OF THE DRAWINGS

Like reference numerals have been used to identify like elements throughout this disclosure.

DETAILED DESCRIPTION

Figure 1:
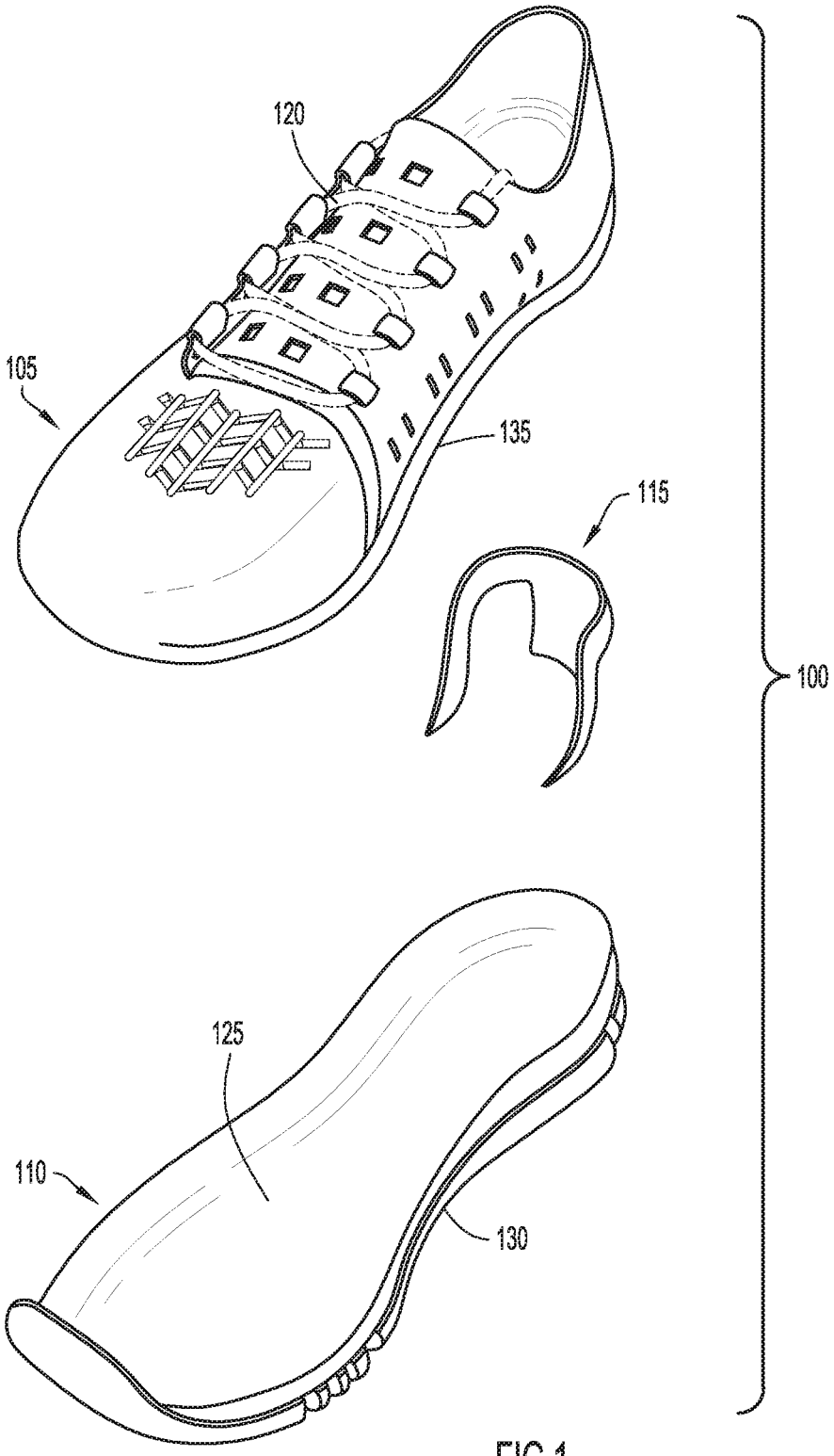
FIG. 1 is an exploded view of an article of footwear in accordance with an embodiment of the invention (footwear configured for a right foot).

As described herein with reference to the example embodiment of FIGS. 1-6, an article of footwear 100 includes an upper 105 coupled to a sole structure 110 and further including a heel counter 115 and a fastening element or fastener 120 (e.g., a lace or cord, which is shown in phantom). In an embodiment, the upper 105 is a textile formed via knitting. Knitting is a process for constructing fabric by interlocking a series of loops (bights) of one or more strands organized in wales and courses. In general, knitting includes warp knitting and weft knitting. In warp knitting, a plurality of strands runs lengthwise in the fabric to make all the loops.

In weft knitting, one continuous strand runs crosswise in the fabric, making all of the loops in one course. Weft knitting includes fabrics formed on both circular knitting and flat knitting machines. With circular knitting machines, the fabric is produced in the form of a tube, with the strands running continuously around the fabric. With a flat knitting machine, the fabric is produced in flat form, the threads alternating back and forth across the fabric. In an embodiment, the upper 105 is formed via flat knitting utilizing stitches including, but not limited to, a plain stitch; a rib stitch, a purl stitch; a missed or float stitch (to produce a float of yarn on the fabric's wrong side); and a tuck stitch (to create an open space in the fabric). The resulting textile includes an interior side (the technical back) and an exterior side (the technical face), each layer being formed of the same or varying strands and/or stitches. By way of example, the knit structure may be a single knit/jersey fabric, a double knit/jersey fabric, and/or a plated fabric (with yarns of different properties are disposed on the face and back). In a specific embodiment, the textile is a double knit fabric formed via a flat knitting process.

The strands forming the textile (and thus the upper 105) may be any natural or synthetic strands suitable for their described purpose (to form a knit upper). The term "strand" includes one or more filaments organized into a fiber and/or an ordered assemblage of textile fibers having a high ratio of length to diameter and normally used as a unit (e.g., slivers, roving, single yarns, plies yarns, cords, braids, ropes, etc.). In a preferred embodiment, a strand is a yarn, i.e., a continuous strand of textile fibers, filaments, or material in a form suitable for knitting, weaving, or otherwise intertwining to form a textile fabric. A yarn may include a number of fibers twisted together (spun yarn); a number of filaments laid together without twist (a zero-twist yarn); a number of filaments laid together with a degree of twist; and a single filament with or without twist (a monofilament).

The strands include elastic strands or inelastic strands. An elastic strand is formed of elastomeric material; consequently, by virtue of its composition, the strand possesses the ability to stretch. Accordingly, an elastic strand possesses elasticity and/or recovery, i.e., the ability to stretch/deform under load and recover to immediately after removal of the load. The degree to which fibers, yarn, or cord returns to its original size and shape after deformation indicates how well a fabric recovers. Some specific examples of elastomers are elastic polymers such as elastomeric polyester-polyurethane copolymers. By way of specific example, elastane, a manufactured fiber in which the fiber-forming substance is a long chain synthetic polymer composed of at least 85% of segmented polyurethane, may be utilized.

In contrast, inelastic strands are not formed of elastomeric material; consequently, by virtue of their composition alone, inelastic strands possess substantially no inherent stretch and recover properties. Hard yarns are a type of inelastic strand. Hard yarns include natural and/or synthetic spun staple yarns, natural and/or synthetic continuous filament yarns, and/or combinations thereof. By way of specific example, natural fibers include cellulosic fibers (e.g., cotton, bamboo) and protein fibers (e.g., wool, silk, and soybean). Synthetic fibers include polyester fibers (poly(ethylene terephthalate) fibers and poly(trimethylene terephthalate) fibers), polycaprolactam fibers, poly(hexamethylene adipamide) fibers, acrylic fibers, acetate fibers, rayon fibers, nylon fibers and combinations thereof.

The strands suitable for forming the upper 105 further include heat sensitive strands. Heat sensitive strands include flowable (fusible) strands and softening. Flowable strands are include polymers that possess a melting and/or glass transition point at which the solid polymer liquefies, generating viscous flow (i.e., becomes molten). In an embodiment, the melting and/or glass transition point of the flowable polymer may be approximately 80° C. to about 150° C. (e.g., 85° C.). Examples of flowable strands include thermoplastic materials such as polyurethanes (i.e., thermoplastic polyurethane or TPU), ethylene vinyl acetates, polyamides (e.g., low melt nylons), and polyesters (e.g., low melt polyester). Preferred examples of melting strands include TPU and polyester. As a strand becomes flowable, it surrounds adjacent strands. Upon cooling, the strands form a rigid interconnected structure that strengthens the textile and/or limits the movement of adjacent strands.

Softening strands are polymeric strands that possess a softening point (the temperature at which a material softens beyond some arbitrary softness). Many thermoplastic polymers do not have a defined point that marks the transition from solid to fluid. Instead, they become softer as temperature increases. The softening point is measured via the Vicat method (ISO 306 and ASTM D 1525), or via heat deflection test (HDT) (ISO 75 and ASTM D 648). In an embodiment, the softening point of the strand is from approximately 60° C. to approximately 90° C. When softened, the strands become tacky, adhering to adjacent stands. Once cooled, movement of the textile strands is restricted (i.e., the textile at that location stiffens).

One additional type of heat sensitive strand which may be utilized is a thermosetting strand. Thermosetting strands are generally flexible under ambient conditions, but become irreversibly inflexible upon heating.

The strands may also include heat insensitive strands. Heat insensitive strands are not sensitive to the processing temperatures experienced by the upper (e.g., during formation and/or use). Accordingly, heat insensitive strands possess a softening, glass transition, or melting point value greater than that of any softening or melting strands present in the textile structure and/or greater than the temperature ranges specified above.

It should be understood that a strand may be categorized in a combination of the above categories. For example, a polyester yarn may be both a heat insensitive and an inelastic strand, as defined above.

Referring to FIGS. 2A-2D, the article of footwear 100 is an athletic shoe (e.g., a running shoe) defining a forefoot region 200A, a midfoot region 200B, and a hindfoot region 200C, as well as a medial side 205A and a lateral side 205B. The forefoot region 200A generally aligns with the ball and toes of the foot, the midfoot region 200B generally aligns with the arch and instep areas of the foot, and the hindfoot region 200C generally aligns with the heel and ankle areas of the foot. Additionally, the medial side 205A is oriented along the medial (big toe) side of the foot, while the lateral side 205B is oriented along the lateral (little toe) side of the foot.

The upper 105 includes a plurality of sections that cooperate to define the foot cavity. A heel section 210 includes heel cup configured to align with and cover the calcaneus area of a human foot. A lateral quarter section 215, disposed forward the heel section 210, is oriented on the lateral shoe side 205B. Similarly, a medial quarter section 220, disposed forward the heel section 210, is oriented on the medial shoe side 205A. A vamp section 225 is disposed forward the quarter sections 215, 225, while a toe cage section 230 is disposed forward the vamp section. The upper 105 may further includes an instep cover section 240 configured to align and span the instep area of the foot and a planum section or footbed 300 (FIG. 3) that engages the planum (bottom) of the foot.

With this configuration, the heel 210, lateral quarter 215, medial quarter 220, vamp 225, toe cage 230 and planum 300 sections cooperate to form a foot cavity 332 (FIG. 3) into which a human foot is inserted by way of an access opening 235 formed cooperatively by the heel 210, the lateral 215 and medial 220 quarters, and the instep cover 240.

The upper 105 may possess a unitary structure (also called a unibody construction) to minimize the number of seams utilized to form the shape of the upper. That is, the upper 105 may be formed as a one-piece template, each template portion being integral with adjacent template portions. Stated yet another way, each section 210, 215, 220, 225, 230, 240, 300 of the upper 105 may include a common strand interconnecting that section with adjacent sections (i.e., the common strand spans both sections). In addition, the connection between adjacent sections may be stitchless and seamless. By stitchless and/or seamless, it is meant that adjacent sections are continuous or integral with each other, including no edges that require joining by stitches, tape, adhesive, welding (fusing), etc.

Figure 2A:
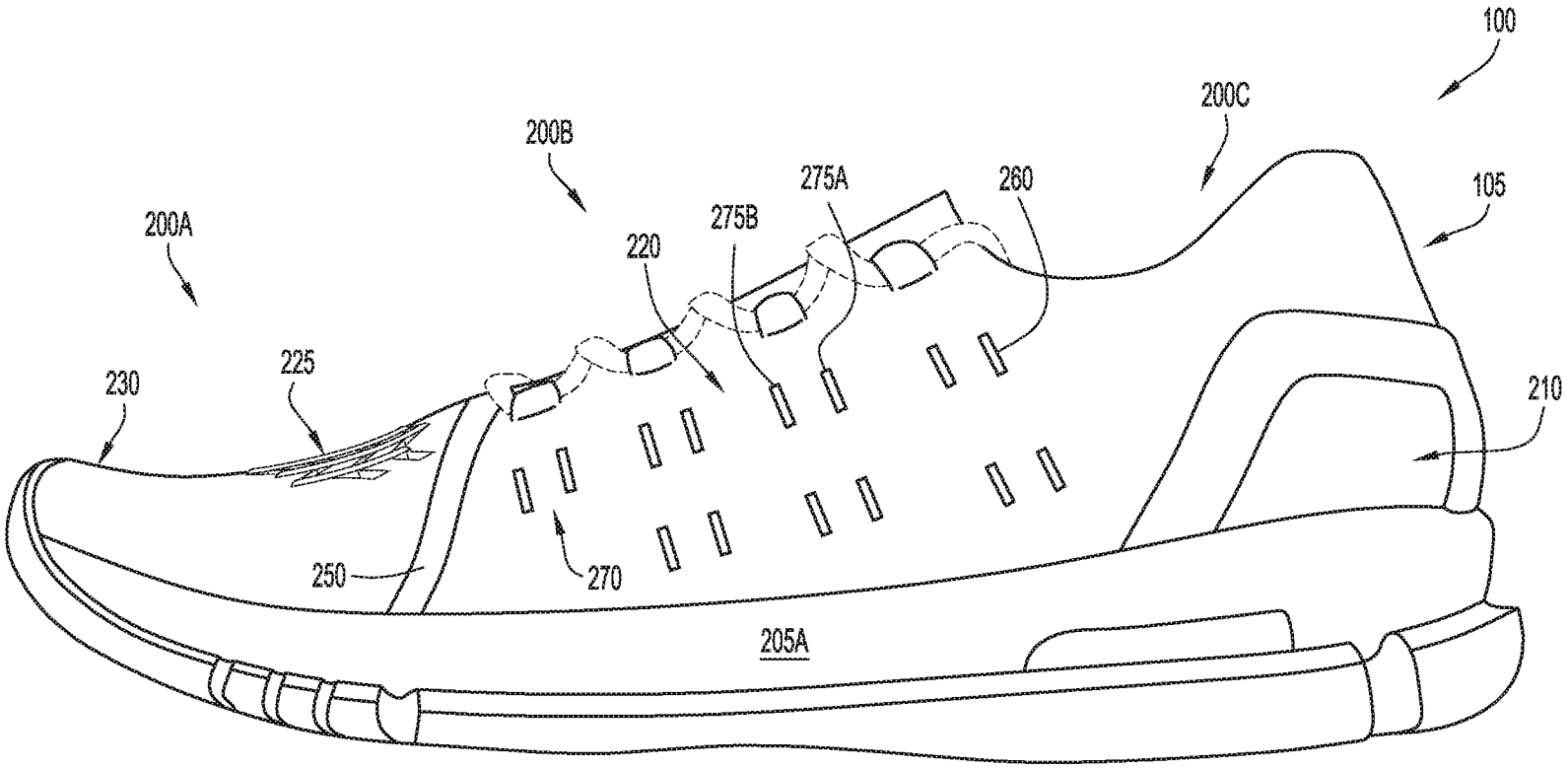
FIG. 2A is side view in elevation of the article of footwear shown in FIG. 1, showing the medial footwear side.
Figure 2B:
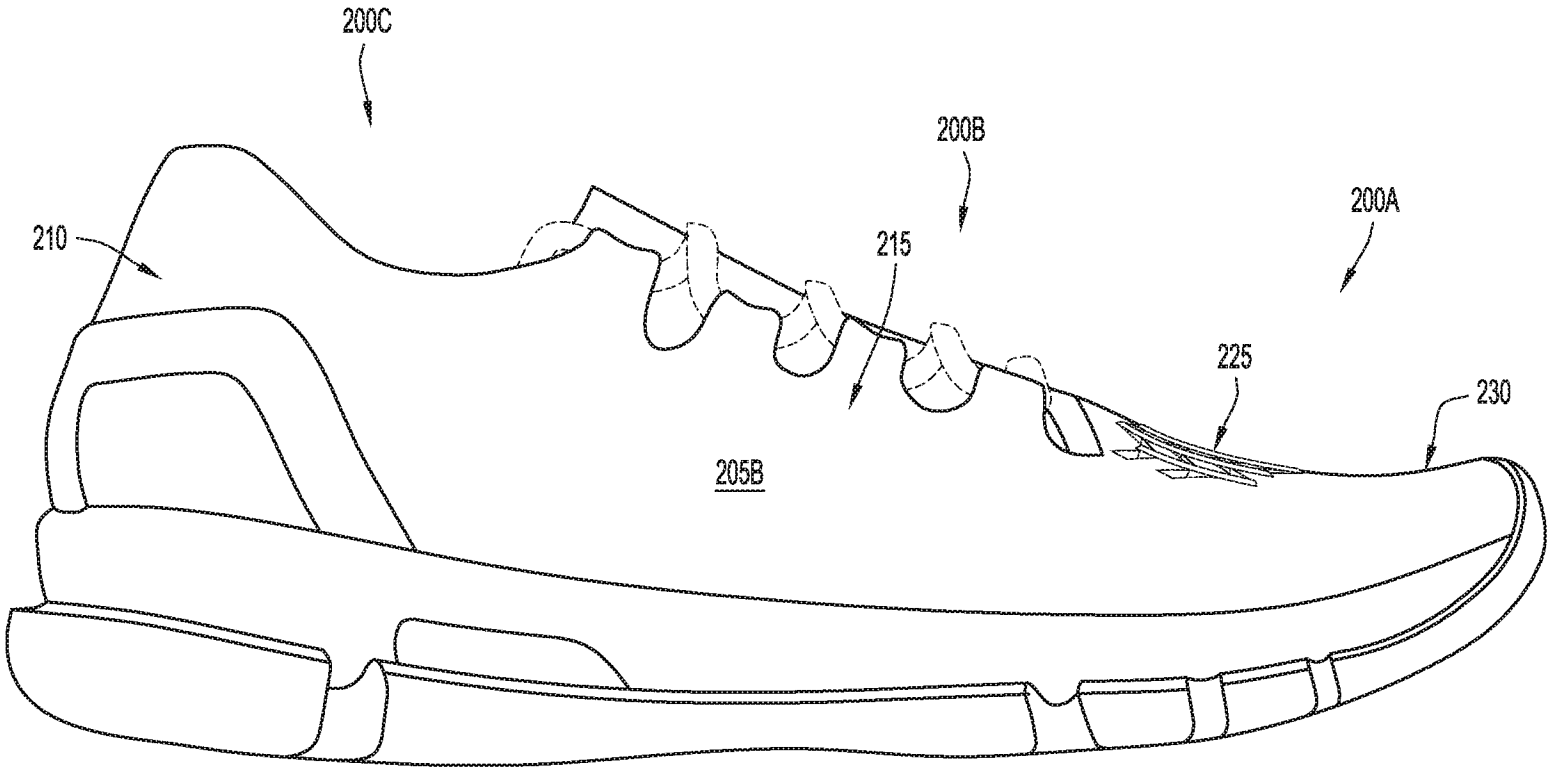
FIG. 2B is a side view in elevation of the article of footwear shown in FIG. 1, showing the lateral footwear side.
Figure 2C:
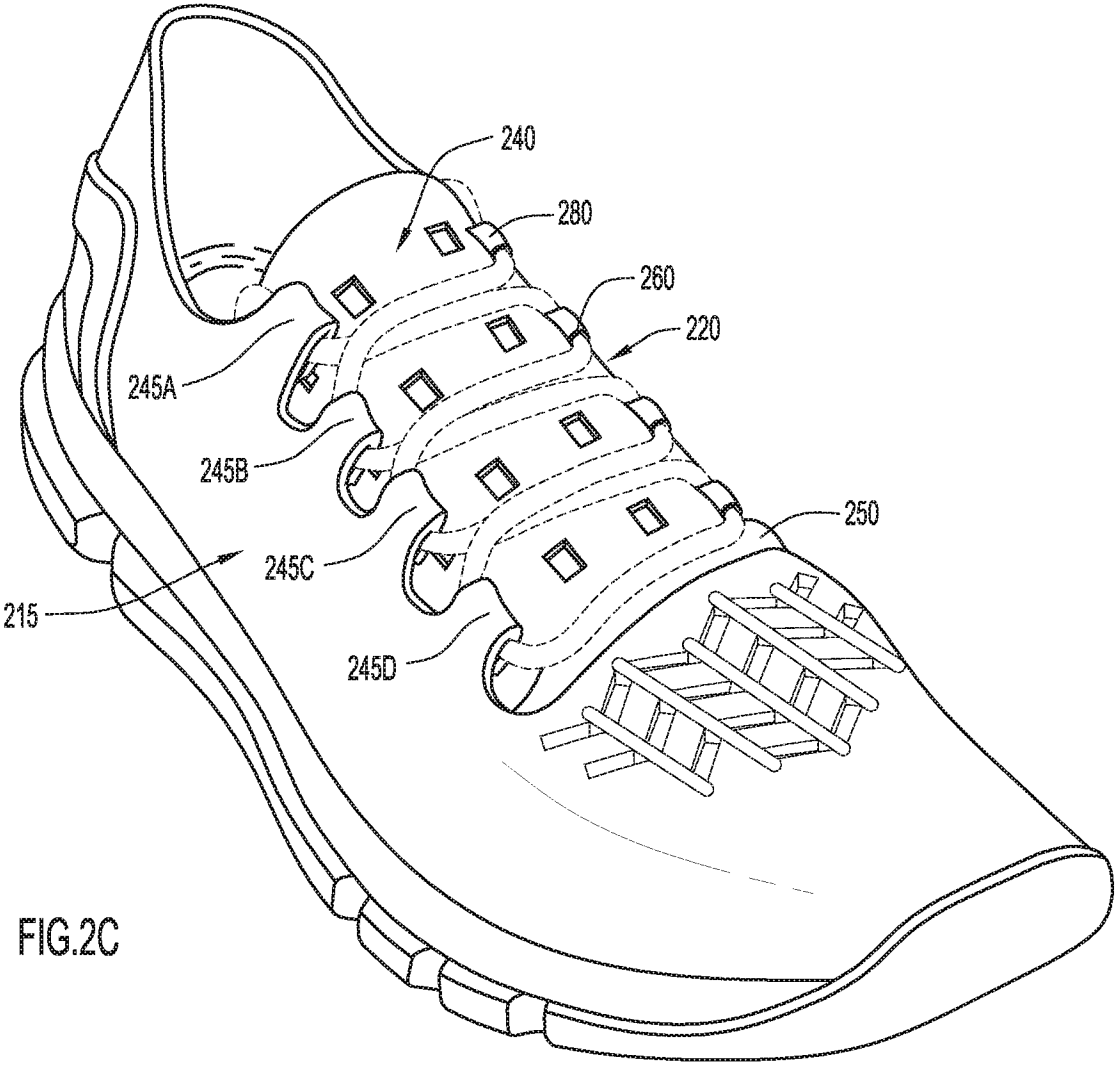
FIG. 2C is a front perspective view of the article of footwear of FIG. 1, showing the lateral footwear side.

Referring to FIG. 2C, the lateral quarter section 215 extends from the heel section 210 to the vamp section 225, traveling upward from the planum section 300 such that the lateral quarter section spans the lateral side of the foot, proximate the hindfoot 200C and midfoot regions 200B. As explained above, the lateral quarter section 215 may be formed integrally (continuous with) with the heel section 210, the vamp section 225, and the planum section 300.

The lateral quarter section 215 is adapted to receive a fastener such as a shoe lace. In an embodiment, the lateral quarter 215 includes a plurality of looped sections 245A, 245B, 245C, 245D disposed at the lateral quarter distal edge (upper edge). As illustrated, the looped sections 245A-245D are linearly spaced, being generally aligned in an array extending longitudinally along the shoe 100. In this manner, each looped section 245A-245D is configured to receive the fastener 120 (the shoe lace), movably capturing the fastener therein. The looped sections 245A-245D, moreover, cooperate with one or more elements disposed on the instep cover 240 to engage the fastener 120 and secure the shoe 100 to the foot of the wearer (described in greater detail, below).

Figure 2D:
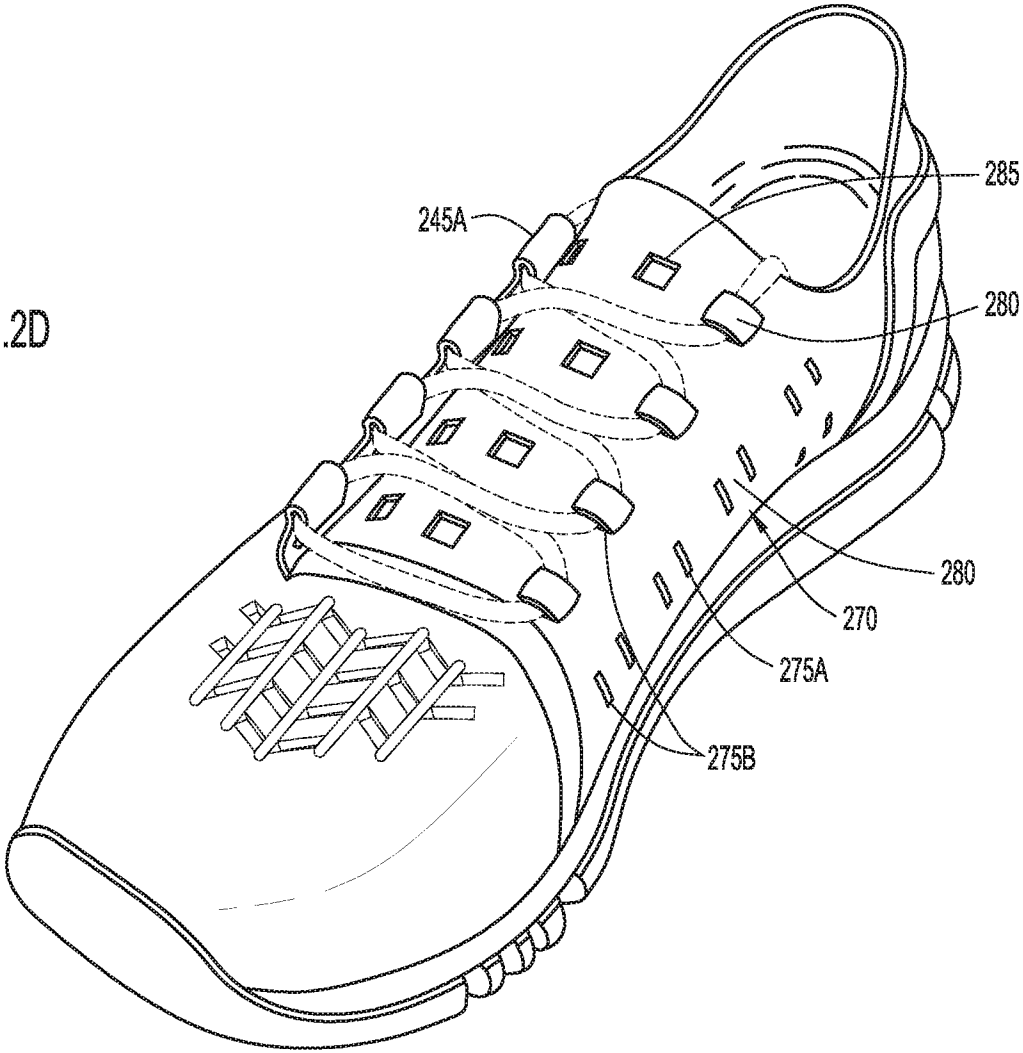
FIG. 2D is a front perspective view of the article of footwear shown in FIG. 1, showing the medial footwear side.
Figure 2E:
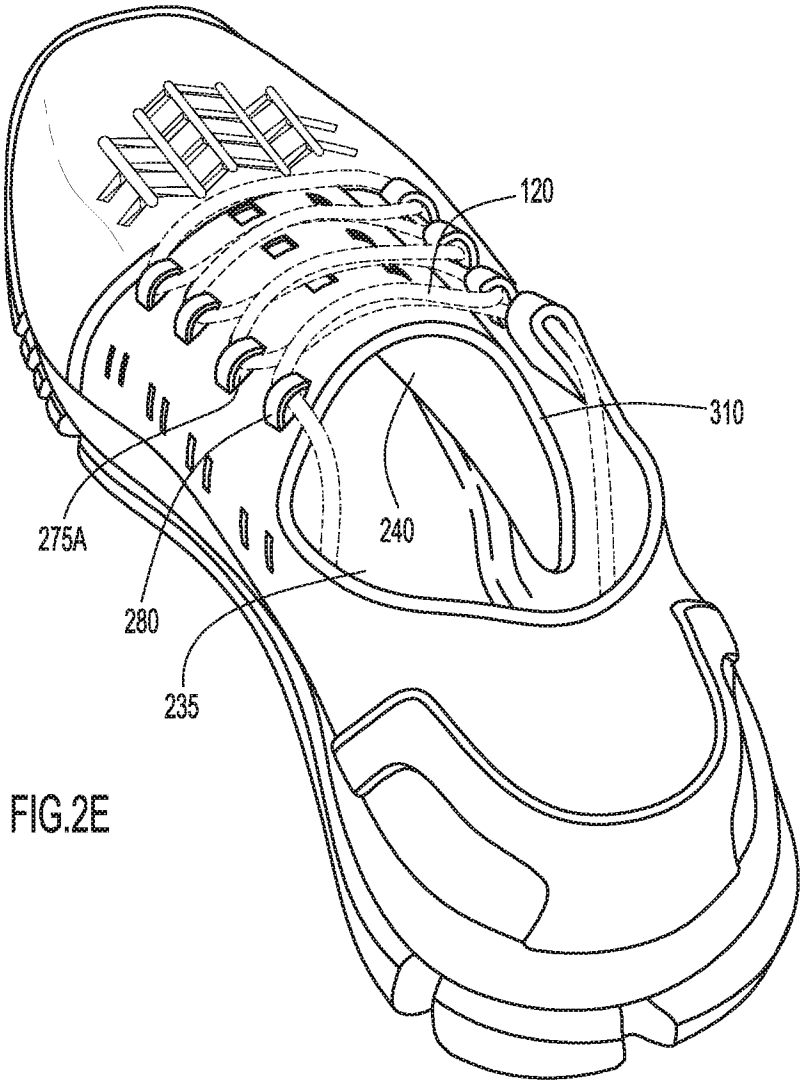
FIG. 2E is a rear perspective view of the article of footwear shown in FIG. 1, showing the medial footwear side.

Referring to FIGS. 2D & 2E, the medial quarter section 220 extends from the heel 210 to the vamp 225, traveling upward from the planum 300 such that the medial quarter spans the medial side of the foot, proximate the hindfoot 200C and midfoot 200B regions. As explained above, the medial quarter 220 may be seamlessly and/or stitchlessly integrated with each of the heel 210, the vamp, and planum 300 sections of the upper.

Figure 3:
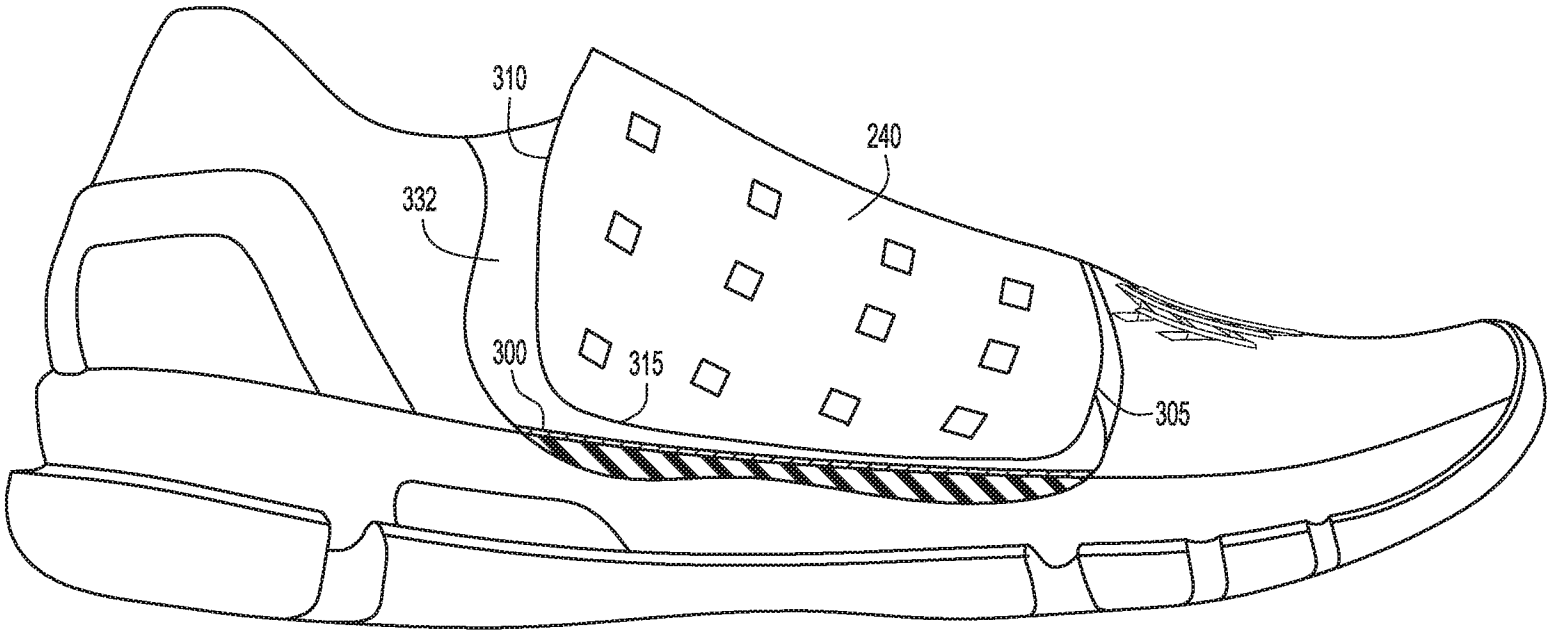
FIG. 3 is a side view in elevation of the article of footwear shown in FIG. 1, showing the lateral footwear side and further including a partial cut-out section.

The instep cover 240 is configured to span the dorsum portion of the midfoot (i.e., the instep). The instep cover 240 may be formed integrally (stitchlessly and/or seamlessly) with the medial quarter section 220. As best seen in FIG. 3, the instep cover 240 defines a forward edge 305 (oriented toward the vamp 225) and a rearward edge 310 oriented generally parallel to the forward edge. The instep cover 240 further defines distal edge 315 oriented generally orthogonal to the forward and rearward edges. The instep cover 240 generally spans the instep of the foot, extending from the medial shoe side 205A to the lateral shoe side 205B, and extending from the throat line 250 of the vamp 225 at its forward edge 305 to the access opening 235 at its rearward edge 310. As noted above, the access opening 235 is partially defined by the rearward edge 310.

The instep cover 240 may include one or more narrow, elongated openings or slots 260 operable to permit passage of the fastener 120 therethrough. The instep cover 240 may also include additional openings or windows 285 operable to improve airflow into/out of the upper.

The forefoot region 200A of the upper 105 includes the vamp section 225, which extends forward from the lateral quarter 215 and medial quarter 220 sections, being formed integrally therewith (e.g., stitchlessly and seamlessly). The vamp section 225 defines the throat line 250 within its proximal region and toe cage 230 within its distal region, the toe cage being configured to span the toes of the foot.

The vamp 225, moreover, includes a microclimate modulation structure (also called microclimate moderation structure) operable to affect movement of heat, air, and/or moisture (e.g., vapor) within the foot cavity 332. Thermal comfort is an important factor considered in footwear design. The microclimate of footwear, which contributes to thermal comfort, is influenced by heat and moisture within the foot cavity. Accordingly, moving heat and/or moisture away from the surface of the foot and/or exhausting heat from the foot cavity 332 optimizes the microclimate which, in turn, optimizes the thermal comfort experienced by the user.

The temperature modulation structure includes strands selected to possess predetermined thermal conductivity values positioned at selected locations within the knit construction of the textile. Specifically, the temperature modulation structure 400 includes first, high thermal conductivity strands and second, low thermal conductivity strands. High conductivity strands are strands that transfer heat along its length (axis) and/or width (transverse dimension) at a higher rate than low thermal conductivity strands. In an embodiment, high thermal conductivity strands are strands formed (e.g., entirely formed) of material possessing a thermal conductivity value greater than 0.40 W/m K. By way of example, the strands may be formed of high density polyethylene (HDPE, 0.45-0.52 @23 C) and/or ultra-high molecular weight polyethylene (UWMW-PE, 0.42-0.51 W/m K @23 C).

In a further embodiment, high thermal conductivity strand is a strand that possessing an axial thermal conductivity of at least 5 W/m K (e.g., at least 10 W/m K or at least 20 W/m K). The high thermal conductivity strand may be a multi-filament fiber such as a gel-spun fiber. By way of specific example, the high conductivity strand is a gel-spun, multi-filament fiber produced from ultra-high molecular weight polyethylene (UHMW-PE), which possesses a thermal conductivity value in the axial direction of 20 W/m K.

The low thermal conductivity strand, in contrast, transfers heat along its length (axis) and/or width (transverse dimension) at a lower rate than that of the high thermal conductivity strand. In an embodiment, the low thermal conductivity strand is formed (e.g., entirely formed) of material possessing a thermal conductivity of no more than 0.40 W/m K. By way of example, the low conductivity strand may be formed of low density polyethylene (LDPE, 0.33 W/m K @23 C), nylon (e.g., nylon 6; nylon 6,6; or nylon 12) (0.23-0.28 W/m K @23° C.), polyester (0.15-0.24 W/m K @23° C.), and/or polypropylene (0.1-0.22 W/m K @23 C).

In another embodiment, the low thermal conductivity strand possesses an axial thermal conductivity (as measured along its axis) that is less than the axial conductivity of the high conductivity strands. By way of example, the low thermal conductivity strands possess an axial thermal conductivity value of less than 5 W/m K when high thermal conductivity strand possesses a thermal conductivity of greater than 5 W/m K; of less than 10 W/m K when high conductivity strand possesses a thermal conductivity of at least 10 W/m K; and/or less than 20 W/m K when high conductivity strand possesses a thermal conductivity of greater than 20 W/m K. Exemplary low thermal conductivity strands include strands formed of polyester staple fibers (axial thermal conductivity: 1.18 W/m K); polyester filament strands (axial thermal conductivity: 1.26 W/m K); nylon fiber strands (axial thermal conductivity: 1.43 W/m K); polypropylene fiber strands (axial thermal conductivity: 1.24 W/m K); cotton strands (axial thermal conductivity: 2.88 W/m K); wool strands (axial thermal conductivity: 0.48 W/m K); silk strands (axial thermal conductivity: 1.49 W/m K); rayon strands (axial thermal conductivity: 1.41-1.89 W/m K); and aramid strands (axial thermal conductivity: 3.05-4.74 W/m K), as well as combinations thereof.

The microclimate modulation structure 400 may further possess a knit construction or structure configured to affect the microclimate of the foot cavity 332 (either independently or in cooperation with the high thermal conductivity strands). Referring to FIGS. 4A, 4B, and 4C, the microclimate modulation structure 400 includes a first construction or portion 405 possessing a first knit construction and a second construction or portion 410 possessing a second knit construction. The first portion 405 forms the central area of the vamp 225, being oriented forward the throat line 250, with its lateral boundaries generally coextensive therewith, and its forward boundary located proximate the toe cage 230. The second portion 410 partially surrounds the first portion 405, being oriented along the forward, medial, and lateral sides of the first portion. Stated another way, the second portion 410 forms the toe cage 230, the lateral side 415 of the vamp 225, and the medial side 420 of the vamp. As illustrated, the first portion 405 is integral with the second portion 410 with a seamless and/or stitchless transition therebetween.

Each portion 405, 410 of the microclimate modulation structure 400 is independently capable of affecting the movement of heat, air, and/or moisture within the cavity and/or exhausting it from the foot cavity 332. It should be understood, however, that the portions 405, 410 cooperate with each other, working in concert to affect the foot cavity microclimate (i.e., the portions operate independently of each other and cooperatively with each other).

Referring to FIGS. 5A, 5B, 5C, and 5D, the first portion 405 of the microclimate modulation structure 400 includes an exterior layer 505 (technical face) plated with an interior layer 510 (technical back). The exterior layer 505 includes a plurality of chambers or pockets operable to position heated and/or moist air away from the area immediately surrounding the foot (or sock exterior surface). The pockets are formed via indentations 515 disposed between the intersection of a plurality of elongated, longitudinal beams or sections 520 extending in a longitudinal or lengthwise direction of the upper 105 (e.g., extending between the throat line 250 and the toe cage 230) with a plurality of elongated, transverse beams or sections 525 extending transversely to the lengthwise direction of the upper (i.e., between lateral 415 and medial 420 sides).

The longitudinal 520 and transverse 525 beams define areas of increased height relative to the indentations 515. In an embodiment, the height of the beams 520, 525 and/or the depths of the indentations 515 is approximately two millimeters or more to provide appropriate spacing of the indentation from the interior layer 510 and/or foot/sock surface (discussed in greater detail below). By way of specific example, a combination of jersey and float stitches may be utilized to form the indentations 515 and beams 520, 525.

Figure 5A:
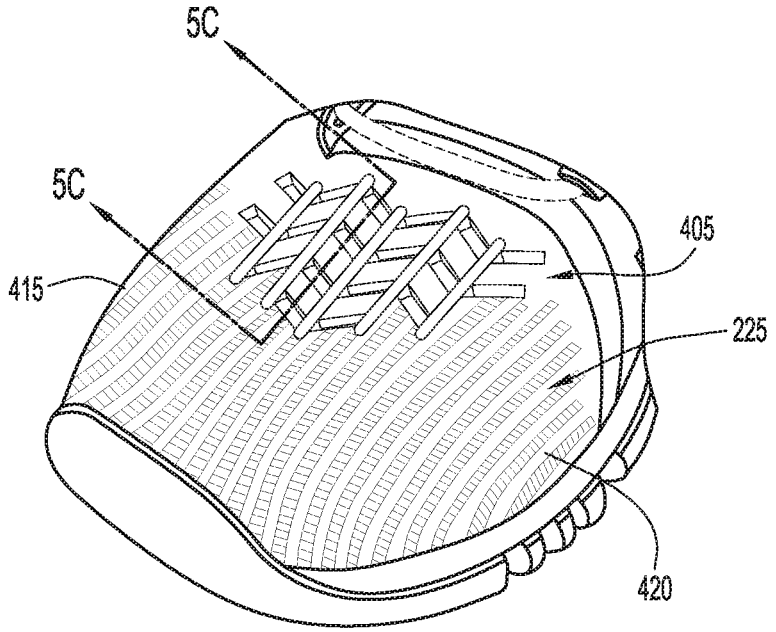
FIG. 5A is a close-up view (medial shoe side) of the vamp section of the article footwear shown in FIG. 4.
Figure 5B:
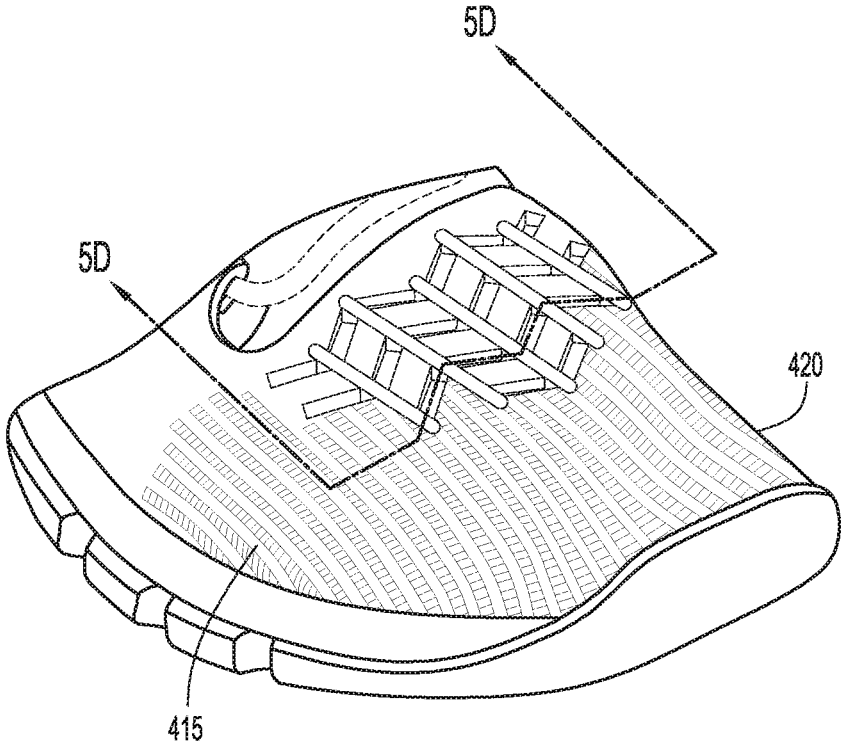
FIG. 5B is a close-up view (lateral shoe side) of the vamp section of the article of footwear shown in FIG. 4.
Figure 5C:
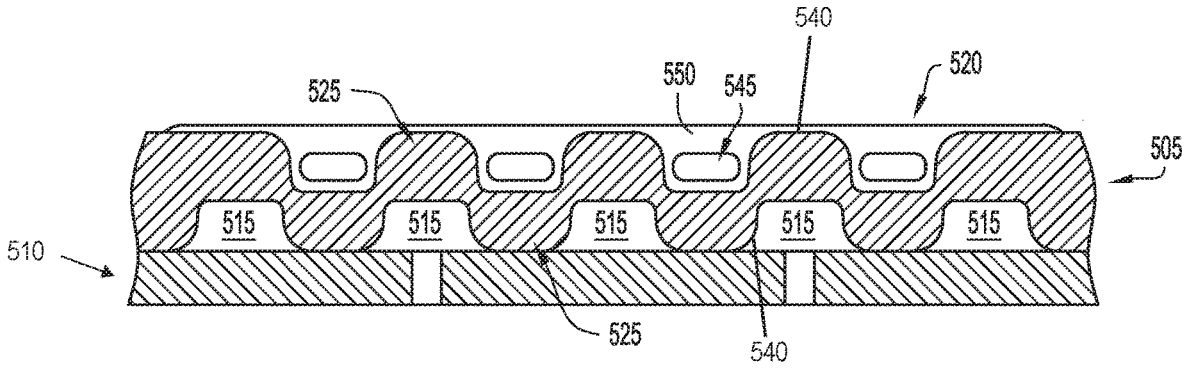
FIG. 5C is cross sectional view of the vamp taken along lines 5C-5C in FIG. 5A.

The knit construction may be configured such that each indentation 515 formed into the outer side 535 of the exterior layer 505 forms a corresponding beam 520, 525 protruding from the inner side 540 of the exterior layer. Similarly, each indentation 515 formed into the inner side 540 of the exterior layer 505 forms a corresponding beam 520, 525 protruding the outer side 535 of the exterior layer (i.e., the topography on the inner side is the negative of the outer side topography). Accordingly, as seen in FIG. 5C, the transverse beams 525 of the outer side 535 define cavities 515 along the inner side 540. Alternatively, the pattern disposed on the inner side 540 may include only the transverse beams 525, defining an indentation 515 between adjacent rows of beams 520 (i.e., omitting longitudinal beams 520).

Each indentation 515 forms a pocket or chamber (e.g., a polygonal or rectangular shaped pocket) within the exterior layer 505 along its inner, foot-cavity-facing side 540. Each pocket is oriented in spaced relation from the immediate foot surface (or sock surface) and/or the interior layer 510. That is, the longitudinal 520 and/or transverse beams 525 on the inner side 540 act as spacers to maintain a gap between the indentations 515 and the foot (and/or the interior layer 510). With this configuration, the resulting pockets are capable of collecting/capturing heated and/or moist air from the foot cavity 332 (e.g., heat generated by the forefoot portion of the foot) and storing it away from the foot/sock surface, thereby increasing wearer comfort. In operation, heated and/or moist air along the surface of the foot travels upward, away from the foot surface and into the pockets, where it is collected. The moist air may travel through apertures 555 formed into the interior layer 510 and aligned with indentations 515. The depth of the indentation 515 and height of the beams 525 may cooperate to create a pocket spaced approximately two millimeters to five millimeters from the foot or sock surface. Moving heated air two millimeters or more from the foot surface improves the microclimate experienced by the wearer.

Figure 5D:
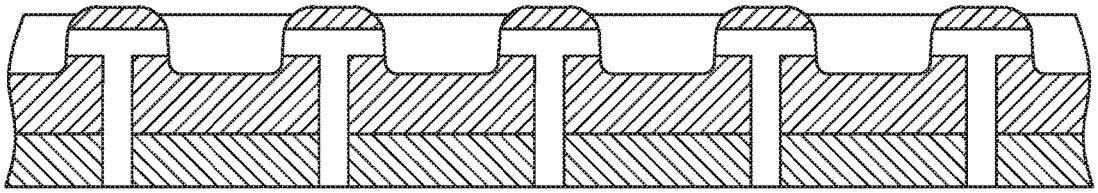
FIG. 5D is cross sectional view of the vamp taken along lines 5D-5D in FIG. 5B.
Figure 6A:
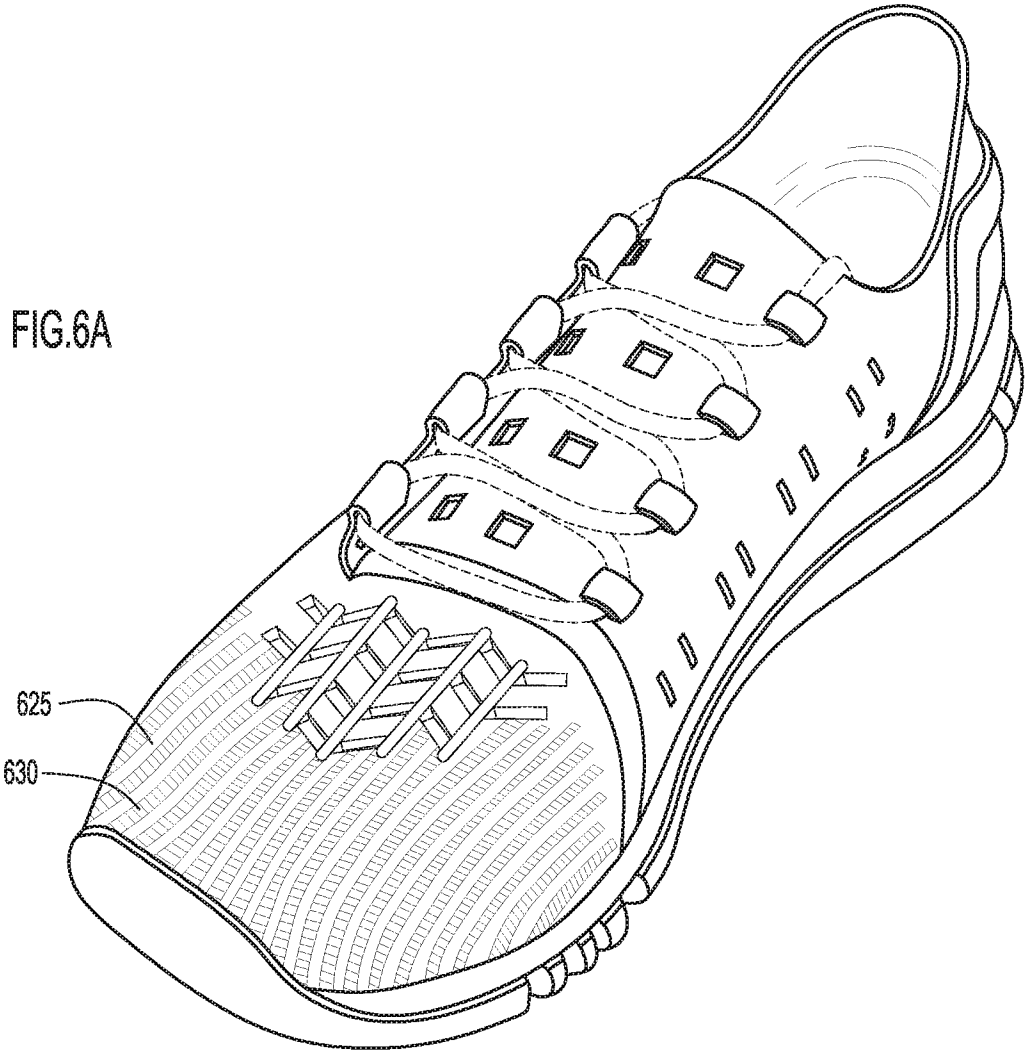
FIG. 6A is a front perspective view of the article of footwear of FIG. 4, showing the medial shoe side.
Figure 6B:
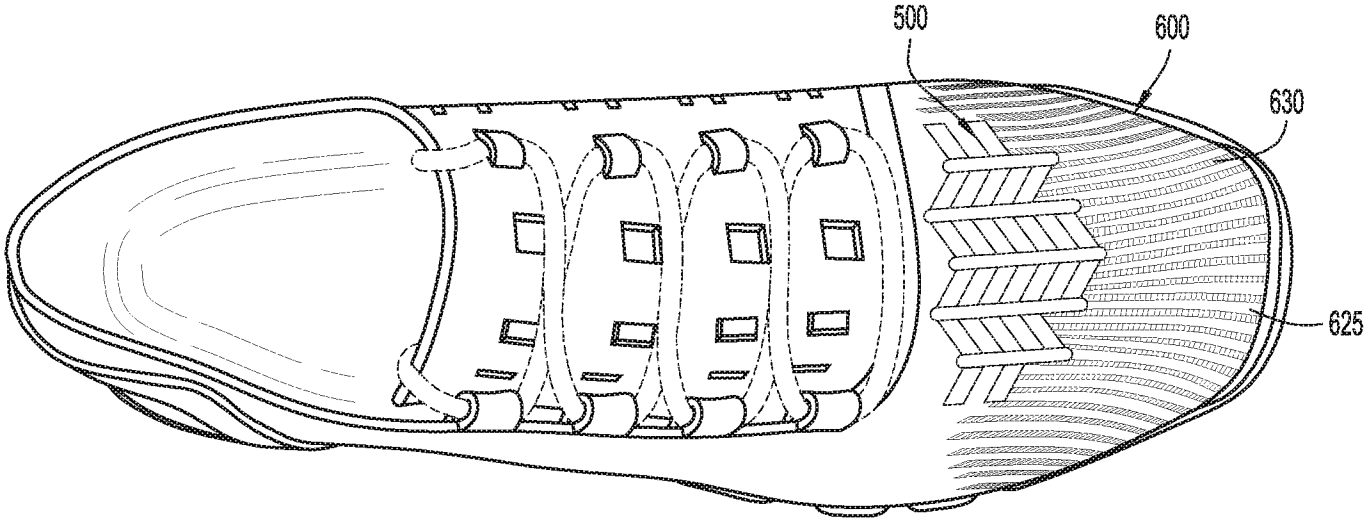
FIG. 6B is a top plan view of the article of footwear of FIG. 4.

The first portion 405 of the microclimate modulation structure 400 may further include exhaust ports 545 (i.e., openings defined in the knit construction) in fluid communication with the foot cavity 332. Referring to FIG. 5D, the outer side 535 of the exterior layer 505 may include exhaust ports 545 positioned along the longitudinal beam 520, proximate an indentation 515. In an embodiment, a pair of exhaust ports 545 is aligned across the longitudinal beam 520 transverse dimension. Stated another way, each longitudinal beam 520 extends over the transverse beams 525 so as to form a bridge-like structure or bridging portion 550 between pairs of neighboring or consecutively aligned beams, with a transverse channel 547 defined beneath the bridging portion of the beam that communicates with neighboring indentations 515 consecutively aligned on each side of the bridging portion of the beam. Each longitudinal beam 520 bridges (via bridging portion 550) the peaks (defined by transverse beams) and valleys (defined by indentations) of the first portion 405, with transverse channels 547 extending transversely through/under each longitudinal beam at the indentation.

In addition, the exterior layer 505 may include vertical channels or passages 552 in communication with the apertures 555 of the interior layer 510.

With this configuration, movement of fluid (air/vapor) is permitted into and out of the foot cavity 332. For example, heated and/or moist air collected/captured within the cavity 332 (i.e., within each indentation 515) travels into the passages 542, through vertical channel 552, and along transverse channel 547, escaping via the exhaust ports 545, thereby improving the foot cavity microclimate.

The interior layer 510, which is exposed to the foot cavity 332, is a generally planar layer that spans the array of indentations 515 and beams 520, 525 of the vamp 225 (i.e., the waffle pattern). In an embodiment, the layer 510 is generally continuous, and may possess a lower stitch density than that of the exterior layer 505 (e.g., to assist fluid movement therethrough). As noted above, the interior layer 510 may further include apertures 555 disposed at selected locations that permit passage of fluid (air/vapor). By way of example, each aperture 555 may be generally aligned with a corresponding pocket or indentation 515 along the interior side 540 of the exterior layer 505. With this configuration, moist or heated air from the foot cavity 332 passes through the apertures 555 and is directed into the pockets 515 of the exterior layer 505 where it is stored away from the user.

As noted above, the portions 405, 410 of the modulation structure 400 are formed of low thermal conductivity strands and high thermal conductivity strands placed at selected locations within the construction. In an embodiment, the interior layer 510 is formed primarily (e.g., >50%), substantially (e.g., >90%), or completely (100%) of high thermal conductivity strands (with any remainder being low conductivity strands). The exterior layer 505, in contrast, is formed primarily, substantially, or completely of low thermal conductivity strands. Accordingly, the interior layer 510 is a thermal conduction layer, being operable to transfer heat at a higher rate than the exterior layer 505. In an embodiment, the interior layer 510 is formed completely of high thermal conductivity strands and the exterior layer 505 is formed completely of low conductivity strands.

It is believed the above described configuration modulates the comfort of the shoe 100 by affecting the movement of moisture, airflow, and/or heat within the foot cavity 332. In operation, heat and water vapor generated by the foot are released into the foot cavity 332, traveling upward, toward the first portion 405 of the microclimate modulation structure 400. The heat and/or water vapor contacts the interior layer 510, which, being formed of high thermal conductivity strands, conducts heat along its volume (its surface area), spreading the heat over a wide surface area to prevent the formation of hot spots and to disperse the heat. In addition, the interior layer 510 draws water vapor away from the foot via the capillary action of the knit structure. Heat and/or water vapor, furthermore, pass through the apertures 555 of the interior layer 510. Once past the interior layer 110, heat and/or vapor are either received by the indentations 515 of the exterior layer 505, being temporarily stored away from the surface of the foot/sock. Additionally, the heat and/or vapor may be exhausted from the foot cavity 332 via exhaust ports 545.

As noted above, the second portion 410 of the microclimate modulation structure 400 surrounds the first portion 405, extending along the lateral 415 and medial 420 sides of the vamp section 225, terminating proximate the throat line 250 at its rear, and extending forward to the toe cage 230. In an embodiment, the second portion 410 includes a plurality of ribs and channels spaced along the technical face (exterior side) and/or the technical back (interior side) of the upper 105. Specifically, referring to FIGS. 4, 6A and 6B, the second portion possesses a double knit construction including by rib (e.g., 2×1 rib) and float (e.g., float single jacquard) stitches. To define integrated interior 610 and exterior 615 layers. The stitches are located to create a series of raised ribs or bands 625 separated by surface channels 630. By way of example, the rib stitches and float stitches are disposed at selected locations to form alternating bands 625 and channels 630 within each layer, the bands being oriented longitudinally along the upper (i.e., the bands extend lengthwise, from throat line 250 to toe cage 230). Specifically, the bands 625 are formed via rib stitches, while the channels 630 are formed via float stitches (where connected loops of the same course are not in adjacent wales).

As with the first portion 405, the second portion 410 includes strands possessing relatively higher and lower thermal conductivity values disposed at selected positions within the construction. For example, the high thermal conductivity strands may be located within the inner layer 610 of the knit structure, or may be located in one or both of the exterior 615 and interior 610 layers of the structure. In an embodiment, the knit construction is configured such that the exterior layer 615 is formed primarily, substantially, or completely of low thermal conductivity strands and the interior layer 610 is formed primarily, substantially, or completely formed of high thermal conductivity strands.

It should be understood, however, that the amount of high thermal conductivity strands present within the second portion 410 of the microclimate modulation structure 410 may be any suitable for its described purpose. In an embodiment, the high thermal conductivity strand 615 forms at least 25% (e.g., at least 30%, at least 40%, at least 50%, etc.) of the second portion 410 (e.g., at least 25% of the strands forming the second portion are high thermal conductivity strands; or at least 25% of the overall strand weight of the second portion is due to the high thermal conductivity strands). In a further embodiment, the high thermal conductivity strands represent no more than 60% of the strands forming the second portion 410 (e.g., the high thermal conductivity strands form 25%-60% of the second portion).

Figure 4:
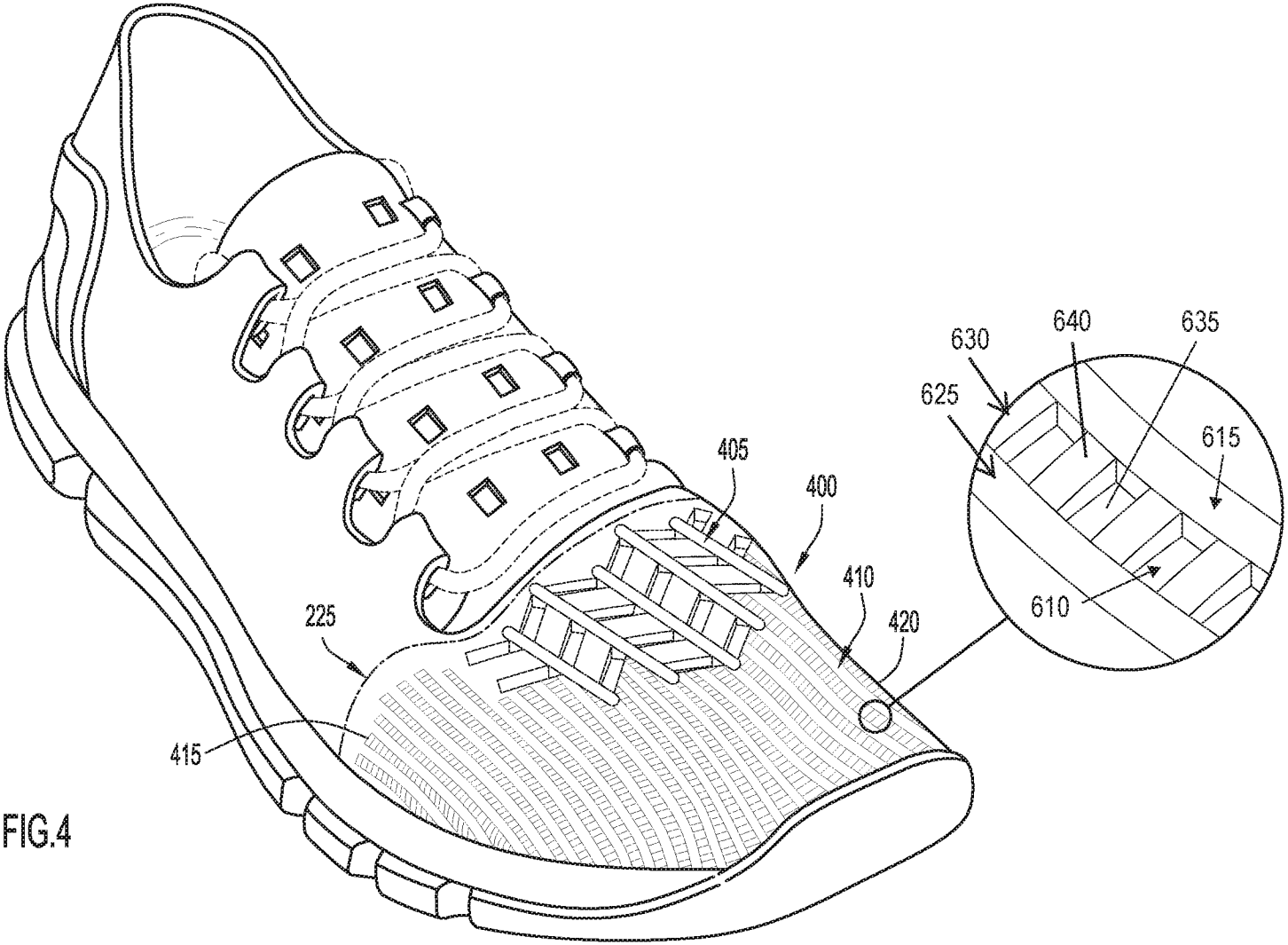
FIG. 4 is a front perspective view of the article of footwear in accordance with the invention, showing the lateral shoe side.

In addition, the knit construction selectively exposes strands forming the interior layer 615 through the exterior layer 610 and, accordingly, the ambient environment. As noted above, each of the exterior 610 and interior 615 layers includes continuous strands forming courses along the crosswise textile direction. The stitches may be selected such that a continuous strand forming the interior layer 615 is exposed at selected locations along the strand length, and vice versa. By way of specific example, selectively placing float stitches within the exterior layer 610 further including ribbing selectively exposes the strand forming the interior layer 610 (technical back, also called the inside loop). With this configuration, the strand possessing high thermal conductivity forming the inner layer (technical back) is selectively exposed, appearing as a transverse bridge between the longitudinal bands of ribbing. Stated another way, and as best seen in FIG. 4, each surface channel 630 includes windows 635 exposing interior layer 610. Each window is defined by adjacent knitted bars 640 extending transversely across the channel 630.

In operation, it is believed multiple independent and/or cooperating mechanisms occur to affect the foot cavity microclimate. Specifically, heat and/or water vapor generated by the foot travels toward the second portion 410. The heat and/or water are either directed along the channels 630, or contact the high thermal conductivity strands. The channels 630 encourage the movement of air, aiding in creating a cooling sensation. In addition, the high thermal conductivity strands transfer heat, spreading it along their lengths such that heat is spread over a wide surface area. The strands of the first portion 405, furthermore, are in communication with the strands of the second portion 410. Accordingly, heat from the first portion is spread across the second portion, and vice versa. Finally, the portions of the high thermal conductivity strand exposed along the exterior layer 610 permits escape of heat absorbed by the high thermal conductivity strand to the ambient environment.

With specific regard to water vapor, hydrophobic, high thermal conductivity strands such as strands formed of UHMW-PE do not absorb water. Accordingly, it is believed that any water vapor present in the cavity contacts the strand, where it is drawn away from the foot cavity 332 via capillary action within the knit structure.

The sole structure 110 comprises a durable, wear-resistant component configured to provide cushioning as the shoe 100 impacts the ground. In certain embodiments, the sole structure 110 may include a midsole and an outsole. In additional embodiments, the sole structure 110 can further include an insole that is disposed between the midsole and the upper 105 when the shoe 100 is assembled. In other embodiments, the sole structure 110 may be a unitary and/or one-piece structure. As can be seen, e.g., in the exploded view of FIG. 1, the sole structure 110 includes an upper facing side 125 and an opposing, ground-facing side 130. The upper facing side 125 may include a generally planar surface and a curved rim or wall that defines the sole perimeter for contacting the bottom surface 135 of the upper 105. The ground-facing side 130 of the sole structure 110 can also define a generally planar surface and can further be textured and/or include ground-engaging or traction elements (e.g., as part of the outsole of the sole structure) to enhance traction of the shoe 100 on different types of terrains and depending upon a particular purpose in which the shoe is to be implemented.

The ground-facing side 130 of the sole structure 110 can also include one or more recesses formed therein, such as indentations or grooves extending in a lengthwise direction of the sole structure 110 and/or transverse the lengthwise direction of the sole structure, where the recesses can provide a number of enhanced properties for the sole structure (e.g., flexure/pivotal bending along grooves to enhance flexibility of the sole structure during use).

The sole structure 110 may be formed of a single material or may be formed of a plurality of materials. In example embodiments in which the sole structure includes a midsole and an outsole, the midsole may be formed of one or more materials including, without limitation, ethylene vinyl acetate (EVA), an EVA blended with one or more of an EVA modifier, a polyolefin block copolymer, and a triblock copolymer, and a polyether block amide. The outsole may be formed of one or more materials including, without limitation, elastomers (e.g., thermoplastic polyurethane), siloxanes, natural rubber, and synthetic rubber.

While the invention has been described in detail and with reference to specific embodiments thereof, it will be apparent to one skilled in the art that various changes and modifications can be made therein without departing from the spirit and scope thereof. For example, while most of the example embodiments depicted in the figures show an article of footwear (shoe) configured for a right foot, it is noted that the same or similar features can also be provided for an article of footwear (shoe) configured for a left foot (where such features of the left footed shoe are reflection or "mirror image" symmetrical in relation to the right footed shoe).

While the figures depict the first microclimate modulation structure 400 as being located in the vamp 225 region of the shoe 100 proximate the instep of the upper 105, it should be understood that the first structure may be located at any location suitable for its described purpose.

Within the knit structure, various stitches may be used to provide different sections 210, 215, 220, 225, 230, 240, 300 of the upper 105 with different properties. For example, a first area may be formed of a first stitch configuration, and a second area may be formed of a second stitch configuration that is different from the first stitch configuration to impart varying textures, structures, patterning, and/or other characteristics to the upper member.

The dimensions (e.g., length, width, and depth), spacing, geometric shape and pattern of the indentations 515, the longitudinal beams 520, and/or the transverse beams 525 can vary for different embodiments to provide different aesthetic and/or heat transfer effects for the upper 105.

Stitching may be utilized to connect sections of the upper together. In addition, a thermoplastic film may be utilized to reinforce seams, replace stitching, and/or prevent fraying. For example, seam tape available from Bemis Associates, Inc. (Shirley, MA) may be utilized.

Instead of an instep cover 240, the upper 105 may include a conventional tongue including a longitudinally extending member free on its lateral and medial sides.

It is to be understood that terms such as "top", "bottom", "front", "rear", "side", "height", "length", "width", "upper", "lower", "interior", "exterior", "inner", "outer", and the like as may be used herein, merely describe points of reference and do not limit the present invention to any particular orientation or configuration.

Thus, it is intended that the present invention covers the modifications and variations of this invention provided they come within the scope of the appended claims and their equivalents.

What is claimed:

1. A method of forming an article of footwear, the method comprising:

knitting a textile by stitching a plurality of strands to form a first knit layer connected with a second knit layer, the second knit layer including a plurality of pockets defined within the second knit layer, wherein:

the knitting further comprises:

knitting an array of indentations and knitted beams disposed at selected locations within the second knit layer, each beam being formed from a plurality of knitted strands, and the plurality of pockets are located between the indentations and corresponding beams extending over the indentations; and knitting a plurality of elongated sections within the second knit layer extending transverse the knitted beams such that knitted beams overlie the elongated sections and include bridging portions that extend over the indentations such that a gap exists between each bridging portion and a corresponding indentation;

the first knit layer includes a knit back and the second knit layer includes a knit face;

the knit back comprises a plurality of first strands possessing a thermal conductivity value of greater than 0.40 W/m K; and the knit face comprises a plurality of second strands possessing a thermal conductivity value of no more than 0.40 W/m K;

incorporating the textile into at least a portion of an upper; and coupling the upper to a sole structure.

2. Then method according to claim 1, wherein each pocket of the plurality of pockets possesses a height of approximately two millimeters or more.

3. The method according to claim 1, wherein:

the upper comprises a vamp including a throat line and a toe cage; and the textile is provided within the vamp of the upper.

4. The method according to claim 3, wherein knitting further comprises stitching the first strands and the second strands such that at least some of the first strands of the knit back are selectively exposed along the knit face.

5. The method according to claim 1, wherein knitting further comprises forming stitches in each of the first knit layer and the second knit layer such that the first knit layer possesses a first stitch density that is lower than a second stitch density of the second knit layer.

6. The method according to claim 1, wherein incorporating the textile into the upper comprises forming the upper such that the second knit layer forms an exterior surface of the upper.

7. A method of forming an article of footwear, the method comprising:

knitting a textile by stitching a plurality of strands to form a first knit layer connected with a second knit layer, wherein:

the first knit layer includes a knit back and the second knit layer includes a knit face;

the knit back comprises a plurality of first strands possessing a thermal conductivity value of greater than 0.40 W/m K;

the knit face comprises a plurality of second strands possessing a thermal conductivity value of no more than 0.40 W/m K; and at least 50% of the first layer is formed with the first strands, and at least 50% of the second layer is formed with the second strands;

incorporating the textile into at least a portion of an upper; and coupling the upper to a sole structure;

wherein the knitting further comprises:

knitting an array of indentations and knitted beams disposed at selected locations within the second knit layer, each beam being formed from a plurality of knitted strands; and knitting a plurality of elongated sections within the second knit layer extending transverse the knitted beams such that knitted beams overlie the elongated sections and include bridging portions that extend over the indentations and a pocket exists between each bridging portion and a corresponding indentation.

* * * * *